US008773317B2

(12) United States Patent
Sakata et al.

(10) Patent No.: US 8,773,317 B2
(45) Date of Patent: Jul. 8, 2014

(54) ANTENNA APPARATUS INCLUDING MULTIPLE ANTENNA PORTIONS ON ONE ANTENNA ELEMENT OPERABLE AT MULTIPLE FREQUENCIES

(75) Inventors: Tsutomu Sakata, Osaka (JP); Atsushi Yamamoto, Kyoto (JP); Satoru Amari, Osaka (JP)

(73) Assignee: Panasonic Corporation, Osaka (JP)

( * ) Notice: Subject to any disclaimer, the term of this patent is extended or adjusted under 35 U.S.C. 154(b) by 596 days.

(21) Appl. No.: 13/063,317

(22) PCT Filed: May 26, 2010

(86) PCT No.: PCT/JP2010/003514

§ 371 (c)(1),
(2), (4) Date: Apr. 6, 2011

(87) PCT Pub. No.: WO2011/004541

PCT Pub. Date: Jan. 13, 2011

(65) Prior Publication Data

US 2011/0187615 A1 Aug. 4, 2011

(30) Foreign Application Priority Data

Jul. 10, 2009 (JP) ..... 2009-163422

(51) Int. Cl.
*H01Q 1/00* (2006.01)

(52) U.S. Cl.
USPC ..... 343/722

(58) Field of Classification Search
USPC ..... 343/722
See application file for complete search history.

(56) References Cited

U.S. PATENT DOCUMENTS

| | | | |
|---|---|---|---|
| 6,163,300 | A | 12/2000 | Ishikawa et al. |
| 6,529,170 | B1 | 3/2003 | Nishizawa et al. |
| 6,759,991 | B2 | 7/2004 | Boyle |
| 6,836,248 | B2 | 12/2004 | Fukushima et al. |
| 7,589,687 | B2 | 9/2009 | Iwai et al. |

(Continued)

FOREIGN PATENT DOCUMENTS

| | | |
|---|---|---|
| CN | 1459138 | 11/2003 |
| CN | 101197464 | 6/2008 |

(Continued)

OTHER PUBLICATIONS

International Preliminary Report on Patentability issued Feb. 23, 2012 in International (PCT) Application No. PCT/JP2010/003514.

(Continued)

*Primary Examiner* — Kristy A Haupt
(74) *Attorney, Agent, or Firm* — Wenderoth, Lind & Ponack, L.L.P.

(57) ABSTRACT

An antenna apparatus includes a slit provided on an antenna element between first and second feed ports; and a series resonant circuit provided at a location along the slit, with a distance from an opening of the slit. When the antenna apparatus operates at a first isolation frequency identical to a resonance frequency of the series resonant circuit, the series resonant circuit is short-circuited, and only a section of the slit from its opening to the series resonant circuit resonates, thus providing isolation between the feed ports at the first isolation frequency. When the antenna apparatus operates at a second isolation frequency lower than the first isolation frequency, the series resonant circuit is open, and the entire slit resonates, thus providing isolation between the feed ports at the second isolation frequency.

9 Claims, 9 Drawing Sheets

(56) References Cited

U.S. PATENT DOCUMENTS

| | | | |
|---|---|---|---|
| 2002/0126052 | A1 | 9/2002 | Boyle |
| 2003/0034917 | A1 | 2/2003 | Nishizawa et al. |
| 2003/0160728 | A1 | 8/2003 | Fukushima et al. |
| 2008/0143612 | A1 | 6/2008 | Iwai et al. |

FOREIGN PATENT DOCUMENTS

| | | |
|---|---|---|
| JP | 5-327331 | 12/1993 |
| JP | 11-55022 | 2/1999 |
| JP | 2001-185938 | 7/2001 |
| JP | 2004-32303 | 1/2004 |
| JP | 2004-129234 | 4/2004 |
| JP | 2004-519914 | 7/2004 |

OTHER PUBLICATIONS

International Search Report issued Sep. 7, 2010 in International (PCT) Application No. PCT/JP2010/003514.

Chinese Office Action along with English translation issued Sep. 3, 2013 in corresponding Chinese Application No. 201080002584.6.

ANTENNA APPARATUS INCLUDING MULTIPLE ANTENNA PORTIONS ON ONE ANTENNA ELEMENT OPERABLE AT MULTIPLE FREQUENCIES

CROSS-REFERENCE(S) TO RELATED APPLICATIONS

This application claims priority to International Application No. PCT/JP2010/003514, filed May 26, 2010, which claims priority to Japanese foreign Application No. 2009-163422, filed Jul. 10, 2009.

TECHNICAL FIELD

The present invention mainly relates to an antenna apparatus for mobile communication such as a mobile phone, and to a wireless communication apparatus including the antenna apparatus.

BACKGROUND ART

The size and thickness of wireless mobile communication apparatuses, such as mobile phones, have been rapidly reduced. Portable wireless communication apparatuses have been transformed from apparatuses to be used only as conventional telephones, to data terminals for transmitting and receiving electronic mails and for browsing web pages of WWW (World Wide Web), etc. Further, since the amount of information to be handled has increased from that of conventional audio and text information to that of pictures and videos, a further improvement in communication quality is required. In addition, portable wireless communication apparatuses are required to handle various applications, including telephone call for voices, data communication for browsing web pages, watching of television broadcasts, etc. In such circumstances, an antenna apparatus operable over a wide frequency range is required for wireless communications of the respective applications.

Conventionally, for example, antenna apparatuses described in Patent Literatures 1 and 2 have been known as antenna apparatuses covering multiple frequency bands.

Patent Literature 1 discloses a two-frequency antenna operable in two frequencies. The two-frequency antenna is characterized by having: elements printed on the front side of a dielectric substrate, including a feed line, an inner radiating element connected to the feed line, and an outer radiating element; an inductor connecting the inner and outer radiating elements printed on the front side of the dielectric substrate; elements printed on the back side of the dielectric substrate, including a feed line, an inner radiating element connected to the feed line, and an outer radiating element; and an inductor connecting the inner and outer radiating elements printed on the back side of the dielectric substrate. The two-frequency antenna of Patent Literature 1 has the inductors each inserted between the inner and outer radiating elements, thus forming a parallel resonant circuit of the inserted inductor and the parasitic capacitance between the elements. Since the parallel resonant circuit is open at a specific frequency when viewed from the antenna feed, only the inner radiating element (i.e., a portion from a feed line to the parallel resonant circuit) is excited at the specific frequency, and both the inner and outer radiating elements (i.e., portions on both sides of the parallel resonant circuit) are excited at the other frequencies. Accordingly, the two-frequency antenna of Patent Literature 1 can achieve multi-band characteristics.

A multi-band antenna of Patent Literature 2 has an antenna element including a first and a second radiating elements connected to both ends of an LC parallel resonant circuit, and is characterized in that the LC parallel resonant circuit is configured by the self-resonance of an inductor itself. The multi-band antenna of Patent Literature 2 can achieve multi-band characteristics by the LC parallel resonant circuit configured by the self-resonance of the radiating elements themselves.

CITATION LIST

Patent Literature

PATENT LITERATURE 1: Japanese Patent Laid-open Publication No. 2001-185938.

PATENT LITERATURE 2: Japanese Patent Laid-open Publication No. H11-055022.

SUMMARY OF INVENTION

Recently, antenna apparatuses using MIMO (Multi-Input Multi-Output) technique for transmitting and/or receiving radio signals of multiple channels simultaneously through space division multiplexing have appeared in order to achieve high-speed communication with increased communication capacity. An antenna apparatus using MIMO communication needs to simultaneously transmit and/or receive multiple radio signals with low correlation to each other, by using different directivities, polarization characteristics, or the like, in order to achieve space division multiplexing.

Although in the configurations of Patent Literatures 1 and 2 the antennas can operate at multiple resonance frequencies, these antennas have only one feeding portion, thus, there is such a problem that these antennas can not be used for MIMO wireless communication apparatuses, diversity wireless communication apparatuses, and adaptive arrays.

An object of the present invention is therefore to solve the above-described problem, and to provide an antenna apparatus capable of simultaneously transmitting and/or receiving multiple radio signals with low correlation to each other and capable of operating at multiple frequencies, with a simple configuration, and to provide a wireless communication apparatus having such an antenna apparatus.

Solution to Problem

According to the first aspect to the present invention, an antenna apparatus is provided, which is provided with first and second feed ports respectively provided at positions on an antenna element, the antenna element being simultaneously excited through the first and second feed ports so as to simultaneously operate as first and second antenna portions respectively associated with the first and second feed ports. The antenna apparatus further provided with: a slit provided on the antenna element between the first and second feed ports; a resonant circuit, which is provided at a location along the slit, with a distance from an opening of the slit, and which is substantially short-circuited at a predetermined resonance frequency and is substantially open at frequencies away from the resonance frequency; and control means for operating the antenna apparatus at a first isolation frequency identical to the resonance frequency of the resonant circuit, and at a second isolation frequency lower than the first isolation frequency. When the antenna apparatus operates at the first isolation frequency, the resonant circuit is substantially short-circuited, and only a section of the slit from the opening to the resonant circuit resonates, thus providing isolation between the first and second feed ports at the first isolation frequency; and when the antenna apparatus operates at the second isolation frequency, the resonant circuit is substantially open, and the entire slit resonates, thus providing isolation between the first and second feed ports at the second isolation frequency.

In the antenna apparatus, the resonant circuit includes a capacitor and an inductor connected in series.

The antenna apparatus is provided with a plurality of resonant circuits provided at locations along the slit, with different distances from the opening of the slit, respectively, the plurality of resonant circuits being substantially short-circuited at different predetermined resonance frequencies and being substantially open at frequencies away from their respective resonance frequencies. The control means operates the antenna apparatus at a plurality of first isolation frequencies each identical to one of the resonance frequencies of the resonant circuits. When the antenna apparatus operates at one of the first isolation frequencies, one of the resonant circuits that has a resonance frequency identical to the one first isolation frequency is substantially short-circuited, and only a section of the slit from the opening to the one resonant circuit resonates, thus providing isolation between the first and second feed ports at the one first isolation frequency.

The antenna apparatus is provided with a reactance element provided along the slit.

The antenna apparatus is provided with a variable reactance element provided along the slit. The control means changes a reactance value of the variable reactance element.

The antenna apparatus is provided with impedance matching means connected to each of the first and second feed ports, the impedance matching means shifting an operating frequency of the antenna element to the first or second isolation frequency under control of the control means.

In the antenna apparatus, the antenna apparatus is configured as a dipole antenna including a first antenna element and a second antenna element. The first feed port is provided at a first position where the first antenna elements opposes to the second antenna elements, and the second feed port is provided at a second position which is different from the first position and where the first antenna elements opposes to the second antenna elements. At least one slit and at least one resonant circuit are provided on at least one of the first and second antenna elements.

According to the second aspect to the present invention, an antenna apparatus is provided, the antenna apparatus is provided with first and second feed ports respectively provided at positions on an antenna element, the antenna element being simultaneously excited through the first and second feed ports so as to simultaneously operate as first and second antenna portions respectively associated with the first and second feed ports. The antenna apparatus is further provided with: a slot provided on the antenna element between the first and second feed ports; a resonant circuit, which is provided at a location along the slot, and which is substantially short-circuited at a predetermined resonance frequency and is substantially open at frequencies away from the resonance frequency; and control means for operating the antenna apparatus at a first isolation frequency identical to the resonance frequency of the resonant circuit, and at a second isolation frequency lower than the first isolation frequency. When the antenna apparatus operates at the first isolation frequency, the resonant circuit is substantially short-circuited, and only a section of the slot from one end of the slot to the resonant circuit resonates, thus providing isolation between the first and second feed ports at the first isolation frequency; and when the antenna apparatus operates at the second isolation frequency, the resonant circuit is substantially open, and the entire slot resonates, thus providing isolation between the first and second feed ports at the second isolation frequency.

According to the third aspect to the present invention, a wireless communication apparatus is provided, the wireless communication apparatus transmitting and receiving multiple radio signals, the wireless communication apparatus including an antenna apparatus of the first or second aspect of the present invention.

As described above, according to an antenna apparatus and a wireless communication apparatus including the antenna apparatus according to the present invention, it is possible to achieve a MIMO antenna apparatus capable of resonating an antenna element at predetermined operating frequencies as well as ensuring high isolation between feed ports, thus operating with a low coupling. The antenna element with the plurality of feed ports is further provided with the slit, thus changing the resonance frequencies of the antenna element. The slit also serves to improve isolation between two feed ports. Further, the resonant circuit is provided at a location along the slit, thus achieving multi-band operation capable of operating at different frequencies as well as ensuring high isolation between the feed ports.

For the purpose of communication using the plurality of feed ports simultaneously, it is necessary to resonate the antenna at a predetermined operating frequency, and to achieve high isolation between the feed ports. The antenna apparatus and the wireless communication apparatus including the antenna apparatus according to the present invention are configured including the matching circuits connected to the respective feed ports, in order to adjust the resonance frequency of the antenna element, and the frequency at which isolation is high, to the same frequency. According to the present invention, it is possible to adjust at least two operating frequencies of the antenna element and to achieve high isolation between the two feed ports at the at least two operating frequencies, and therefore, it is possible to provide the wireless communication apparatus capable of transmitting and/or receiving multiple radio signals simultaneously, at multiple frequencies.

According to the present invention, while using only one antenna elements, it is possible to operate the antenna element as multiple antenna portions at least two frequencies, and also ensure isolation between the multiple antenna portions. By ensuring isolation and low coupling between multiple antenna portions of the MIMO antenna apparatus, it is possible to use the respective antenna portions for simultaneously transmitting and/or receiving multiple radio signals with low correlation to each other. In addition, it is possible to adjust the operating frequency of the antenna element, thus supporting at least two of applications using different frequencies.

DETAILED DESCRIPTION OF INVENTION

Figure 1:
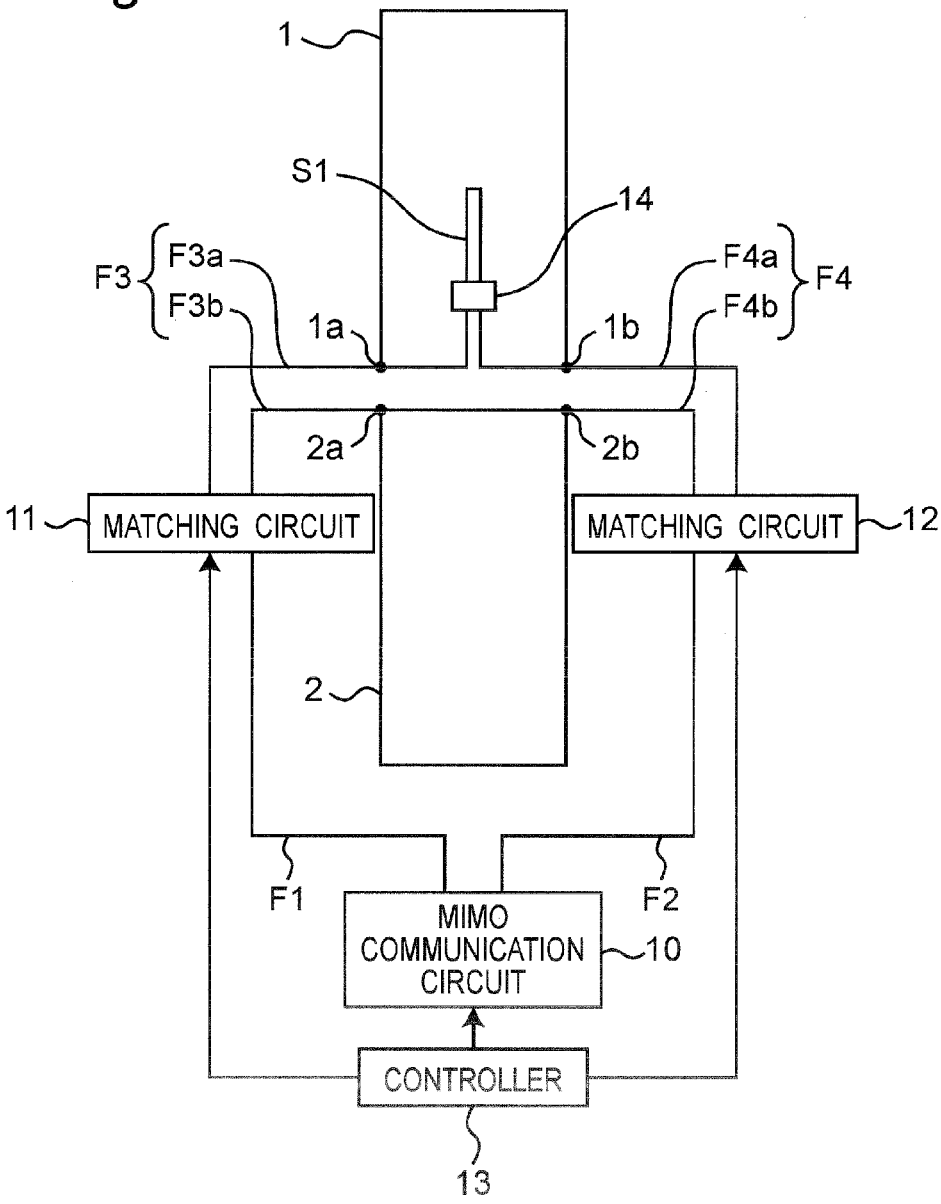
FIG. 1 is a block diagram showing a schematic configuration of an antenna apparatus according to an embodiment of the present invention.

An embodiments according to the present invention will be described below with reference to the drawings. Note that similar components are denoted by the same reference numerals.

FIG. 1 is a block diagram showing a schematic configuration of an antenna apparatus according to an embodiment of the present invention. The antenna apparatus of the present embodiment includes a rectangular antenna element 1 having two distinct feed points 1*a* and 1*b*, and the single antenna element 1 operates as two antenna portions by exciting the antenna element 1 through the feed point 1*a* as a first antenna portion, and simultaneously, exciting the antenna element 1 through the feed point 1*b* as a second antenna portion.

In general, if a single antenna element is provided with a plurality of feed ports (or feed points), then isolation between the feed ports can not be ensured, thus increasing electromagnetic coupling between individual antenna portions, and increasing correlation between signals. Therefore, for example, upon reception, the identical received signal is outputted from each feed port. In such a case, good characteristics for diversity or MIMO can not be obtained. The antenna apparatus of the present embodiment is characterized by providing a slit S1 between the feed points 1*a* and 1*b* of the antenna element 1, and characterized by providing a series resonant circuit 14 at a location along the slit S1, so that providing the slit S1 and the series resonant circuit 14 results in a plurality of frequencies at each of which high isolation between the feed points 1*a* and 1*b* can be ensured.

Figure 2:
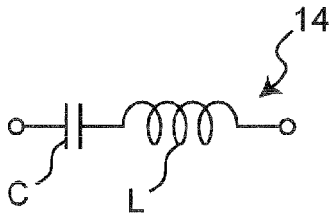
FIG. 2 is a circuit diagram showing a series resonant circuit 14 of FIG. 1.

Referring to FIG. 1, the antenna apparatus includes the antenna element 1 and a ground conductor 2, each made of a rectangular conductive plate. The antenna element 1 and the ground conductor 2 are spaced apart from each other by a certain distance, such that one side of the antenna element 1 opposes to one side of the ground conductor 2. Feed ports are provided respectively at both ends of the pair of opposing sides of the antenna element 1 and the ground conductor 2. One feed port includes the feed point 1*a* provided on the antenna element 1 at one end of the side opposing to the ground conductor 2 (in FIG. 1, a lower left end of the antenna element 1), and includes a connection point 2*a* provided on the ground conductor 2 at one end of the side opposing to the antenna element 1 (in FIG. 1, an upper left end of the ground conductor 2). The other feed port includes the feed point 1*b* provided on the antenna element 1 at the other end of the side opposing to the ground conductor 2 (in FIG. 1, a lower right end of the antenna element 1), and includes a connection point 2*b* provided on the ground conductor 2 at the other end of the side opposing to the antenna element 1 (in FIG. 1, an upper right end of the ground conductor 2). The antenna element 1 is further provided with the slit S1 between the two feed ports, i.e., between the feed points 1*a* and 1*b*, in order to adjust electromagnetic coupling between the antenna portions and ensuring certain isolation between the feed ports. The slit S1 has a certain width and a certain length, and one end of the slit S1 is configured as an open end, with an opening on the side between the feed points 1*a* and 1*b*. The antenna apparatus is further provided with the series resonant circuit 14 for changing the effective length of the slit S1, at a location along the slit S1, with a distance from the opening of the slit S1. FIG. 2 is a circuit diagram showing the series resonant circuit 14 of FIG. 1. The series resonant circuit 14 is made of a capacitor C and an inductor L connected in series, and is connected across conductors of both sides of the slit S1. The series resonant circuit 14 resonates only at a predetermined resonance frequency and makes its impedance zero (i.e., is substantially short-circuited), and is substantially open at the other frequencies away from the resonance frequency. Therefore, the series resonant circuit 14 allows only a section of the slit S1 from its opening to the series resonant circuit 14 to resonate at the resonance frequency, and allows the entire slit S1 to resonate at the other frequencies away from the resonance frequency.

The feed point 1*a* and the connection point 2*a* are connected to an impedance matching circuit 11 (hereinafter, referred to as a "matching circuit 11") through signal lines F3*a* and F3*b* (hereinafter, collectively referred to as a "feed line F3"). The matching circuit 11 is connected to a MIMO communication circuit 10 through a feed line F1. Similarly, the feed point 1*b* and the connection point 2*b* are connected to an impedance matching circuit 12 (hereinafter, referred to as a "matching circuit 12") through signal lines F4*a* and F4*b* (hereinafter, collectively referred to as a "feed line F4"). The matching circuit 12 is connected to the MIMO communication circuit 10 through a feed line F2. Each of the feed lines F1 and F2 is made of, e.g., a coaxial cable with a characteristic impedance of 50Ω. Similarly, each of the feed lines F3 and F4 is made of, e.g., a coaxial cable with a characteristic impedance of 50Ω, and in this case, the signal lines F3*a* and F4*a* as inner conductors of the coaxial cables connect the antenna element 1 to the matching circuits 11 and 12, respectively, and the signal lines F3*b* and F4*b* as outer conductors of the coaxial cables connect the ground conductor 2 to the matching circuits 11 and 12, respectively. Alternatively, each of the feed lines F3 and F4 may be made of a balanced feed line. The MIMO communication circuit 10 transmits and receives radio signals of multiple channels of a MIMO communication scheme (in the present embodiment, two channels) through the antenna element 1.

The present embodiment is configured as described above, and accordingly, the antenna element 1 is excited as a first antenna portion through one feed port (i.e., the feed point 1*a*), and simultaneously excited as a second antenna portion through the other feed port (i.e., the feed point 1*b*), thus operating the single antenna element 1 as two antenna portions. Then, it is possible to achieve a MIMO antenna apparatus capable of resonating the antenna element 1 at desired operating frequencies as well as ensuring high isolation between the feed ports, thus operating with a low coupling.

Effects of providing the antenna element 1 with the slit S1 and the series resonant circuit 14 are as follows. Providing the slit S1 decreases the resonance frequency of the antenna element 1 itself. Further, the slit S1 operates as a resonator having a resonance frequency dependent on the effective length of the slit S1. Since the slit S1 is electromagnetically coupled to the antenna element 1 itself, the resonance frequency of the antenna element 1 changes according to the resonance frequency of the slit S1, as compared to the case without the slit S1. Providing the slit S1 can change the resonance frequency of the antenna element 1, and increase isolation between the feed ports at a certain frequency. Therefore, the frequency at which high isolation can be ensured between the feed ports (hereinafter, referred to as an "isolation frequency") changes according to the effective length of the slit S1. When the impedance of the series resonant circuit 14 is zero, the slit S1 is substantially short-circuited at the location of the series resonant circuit 14, and the effective length of the slit S1 becomes the length of the section of the slit S1 from its opening to the series resonant circuit 14. If the effective length of the slit S1 is reduced, then its resonance frequency increases, and its isolation frequency is also high as compared to the case that the entire slit S1 resonates. In order to achieve at a predetermined frequency both the short-circuiting of the series resonant circuit 14 and the ensuring of isolation, the location of the series resonant circuit 14 is adjusted along the slit S1 (i.e., the effective length of the slit S1 is adjusted) so that the isolation frequency is identical to the resonance frequency of the series resonant circuit 14.

In general, the isolation frequency is not identical to the resonance frequency of the antenna element 1. Therefore, in the present embodiment, the matching circuits 11 and 12 are provided between the feed ports and the MIMO communication circuit 10, in order to shift the operating frequency of the antenna element 1 (i.e., a frequency at which a desired signal is transmitted and received) from the resonance frequency changed due to the slit S1, to the isolation frequency. Providing the matching circuits 11 and 12 affects both the resonance frequency of the antenna element 1 and the isolation frequency, but mainly contributes to changing the resonance frequency. As a result of providing the matching circuit 11, at a terminal of the matching circuit 11 on the side of the MIMO communication circuit 10 (i.e., a terminal on the side connected to the feed line F1), an impedance when seen from the terminal to the antenna element 1 matches with an impedance when seen from the terminal to the MIMO communication circuit 10 (i.e., a characteristic impedance of 50Ω of the feed line F1). Similarly, as a result of providing the matching circuit 12, at a terminal of the matching circuit 12 on the side of the MIMO communication circuit 10 (i.e., a terminal on the side connected to the feed line F2), an impedance when seen from the terminal to the antenna element 1 matches with an impedance when seen from the terminal to the MIMO communication circuit 10 (i.e., a characteristic impedance of 50Ω of the feed line F2).

The effective length of the slit S1 changes depending on whether the operating frequency of the antenna element 1 is identical to the resonance frequency of the series resonant circuit 14. When these frequencies are identical, the effective length of the slit S1 is the length of the section of the slit S1 from its opening to the series resonant circuit 14, or otherwise, the effective length of the slit S1 is the length of the entire slit S1. Therefore, the antenna apparatus of the present embodiment is configured to change the operating frequency of the antenna element 1 to change the effective length of the slit S1, thus achieving different resonance frequencies and ensuring isolation between the feed ports at each of different frequencies. In the present embodiment, it is possible to obtain two different isolation frequencies, by changing the operating frequency of the antenna element 1 to change the effective length of the slit S1. Specifically, a controller 13 operates the antenna apparatus at a first isolation frequency identical to the resonance frequency of the series resonant circuit 14, and operates the antenna apparatus at a second isolation frequency lower than the first isolation frequency. When the antenna apparatus operates at the first isolation frequency, the series resonant circuit 14 is substantially short-circuited, and only the section of the slit S1 from its opening to the series resonant circuit 14 resonates, thus providing isolation between the first and second feed ports at the first isolation frequency. When the antenna apparatus operates at the second isolation frequency, the series resonant circuit 14 is substantially open, and the entire slit S1 resonates, thus providing isolation between the first and second feed ports at the second isolation frequency. In this case, the controller 13 adjusts the operating frequencies of the MIMO communication circuit 10 and the matching circuits 11 and 12 to selectively shift the operating frequency of the antenna element 1 to either one of the two isolation frequencies. In the present embodiment, it is possible to achieve multi-frequency operation of the antenna apparatus (multi-band operation) by means of the above-described configuration.

Figure 3:
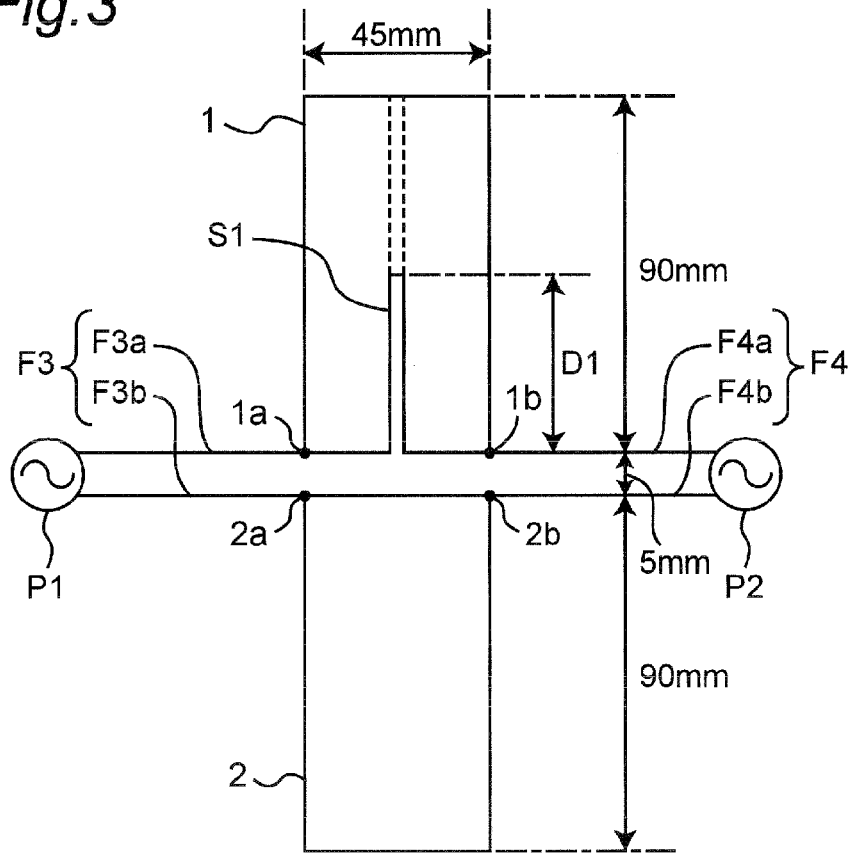
FIG. 3 is a diagram showing a schematic configuration of the antenna apparatus for explaining the operating principle of a slit S1 of FIG. 1.

Now, the operating principles of the antenna apparatus of the present embodiment will be described below with reference to FIGS. 3 to 6. FIG. 3 is a diagram showing a schematic configuration of the antenna apparatus for explaining the operating principle of the slit S1 of FIG. 1. The antenna apparatus of FIG. 3 shows that the resonance frequency of the antenna element 1 and the isolation frequency change depending on a length D1 of the slit S1.

Referring to FIG. 3, each of the antenna element 1 and a ground conductor 2 is made of a single-sided copper-clad substrate with a size of 45×90 mm. A conductor is entirely removed at the center in width of the antenna element 1 by a width of 1 mm, and a copper tape is attached to a portion where the conductor is removed, thus forming a slit S1 with a desired length D1. The length D1 of the slit S1 is adjusted to examine a change in the frequency characteristics of the antenna apparatus. Further, as feed lines F3 and F4, semi-rigid cables with a length of 50 mm are respectively connected to two feed ports of the antenna apparatus (i.e., a feed port including a feed point 1*a* and a connection point 2*a*, and another feed port including a feed point 1*b* and a connection point 2*b*). Inner conductors of the respective semi-rigid cables are soldered to the substrate of the antenna element 1 over a length of 5 mm, and outer conductors of the respective semi-rigid cables are soldered to the substrate of the ground conductor 2 over a length of 40 mm. Furthermore, the feed lines F3 and F4 are respectively connected to signal sources, which are schematically shown as "P1" and "P2" in FIG. 3.

Figure 4:
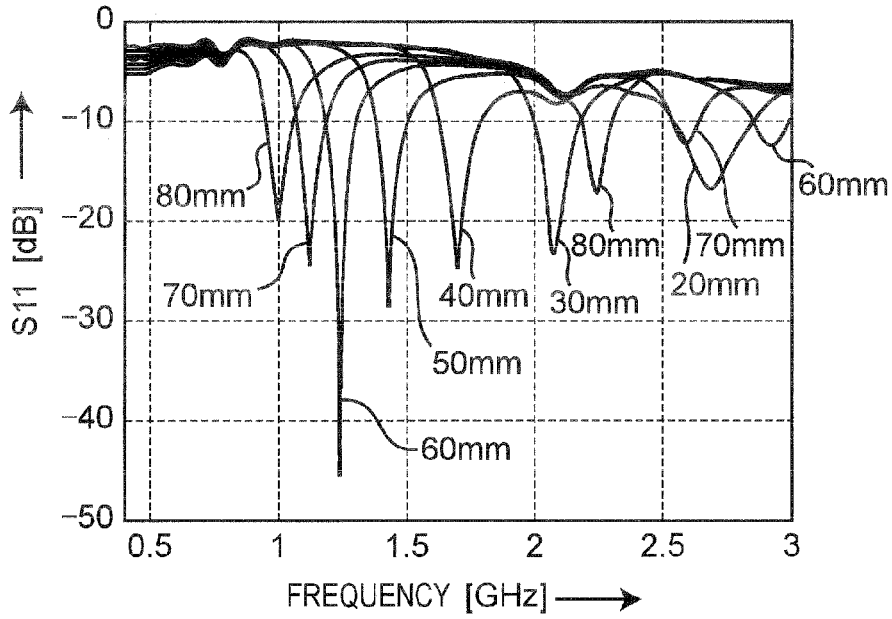
FIG. 4 is a graph showing a reflection coefficient parameter S11 versus frequency for different lengths D1 of the slit S1 in the antenna apparatus of FIG. 3.
Figure 5:
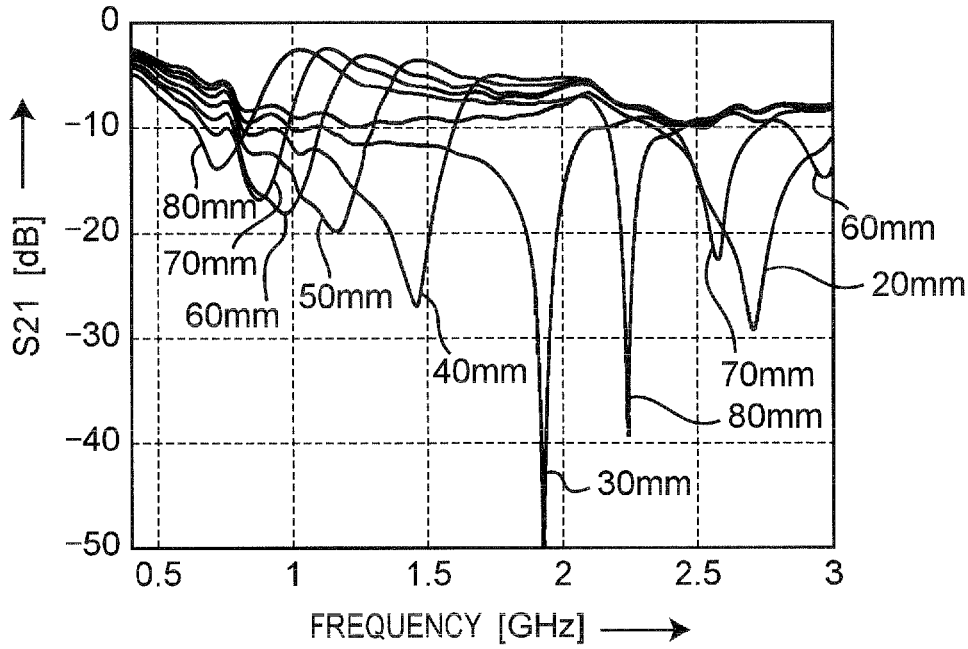
FIG. 5 is a graph showing a transmission coefficient parameter S21 versus frequency for different lengths D1 of the slit S1 in the antenna apparatus of FIG. 3.

Next, with reference to FIGS. 4 and 5, it is shown how the frequency characteristics of S-parameters S11 and S21 for the two feed ports change when changing the length D1 of the slit S1. FIG. 4 is a graph showing a reflection coefficient parameter S11 versus frequency for different lengths D1 of the slit S1 in the antenna apparatus of FIG. 3. FIG. 5 is a graph showing a transmission coefficient parameter S21 (i.e., the characteristic of isolation between the feed ports) versus frequency for different lengths D1 of the slit S1 in the antenna apparatus of FIG. 3. Since the antenna apparatus of FIG. 3 has a symmetric structure, the parameter S12 is the same as S21, and the parameter S22 is the same as S11. According to FIGS.

4 and 5, it can be seen that the resonance frequency of the antenna element 1 and the isolation frequency change by changing the length D1 of the slit S1.

The following table shows the relationship between a change in the resonance frequency of the antenna element 1 (in GHz) and a change in isolation frequency (in GHz) when changing the length D1 of the slit S1 (in mm).

TABLE 1

| D1 | S11 | S21 |
|---|---|---|
| 20 | 2.680 | 2.703 |
| 25 | 2.313 | 2.309 |
| 30 | 2.074 | 1.934 |
| 35 | 1.856 | 1.658 |
| 40 | 1.700 | 1.463 |
| 45 | 1.538 | 1.278 |
| 50 | 1.430 | 1.172 |
| 55 | 1.333 | 1.068 |
| 60 | 1.239 | 0.974 |
| 65 | 1.170 | 0.902 |
| 70 | 1.120 | 0.876 |
| 75 | 1.063 | 0.855 |
| 80 | 0.996 | 0.732 |
| 85 | 0.954 | 0.731 |

Figure 6:
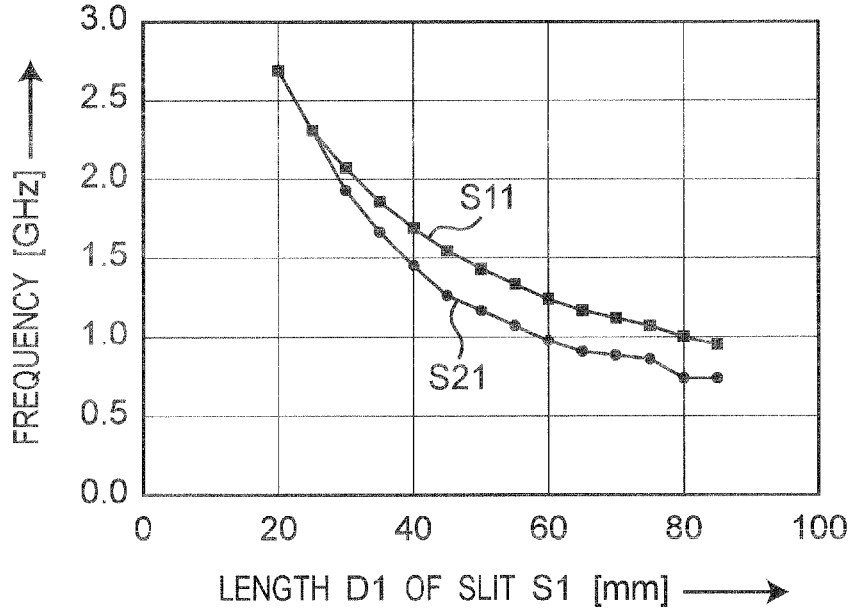
FIG. 6 is a graph showing frequency characteristics versus the length D1 of the slit S1 for the antenna apparatus of FIG. 3.

The relationship shown in the above Table 1 is also shown in a graph of FIG. 6. FIG. 6 is a graph showing frequency characteristics versus the length D1 of the slit S1 for the antenna apparatus of FIG. 3. According to Table 1 and FIG. 6, it can be seen that the longer the slit S1, the lower the resonance frequency of the antenna element 1 and the isolation frequency. As to the parameter S21, it is considered that the isolation frequency has decreased because of an increase in a diverting path length from the feed point 1*a* to the feed point 1*b*. The frequency variation are ranged from 960 MHz to 2.6 GHz for the parameter S11, and 730 MHz to 2.7 GHz for the parameter S21.

According to FIGS. 3 to 6, it can be seen that the resonance frequency of the antenna element 1 and the isolation frequency change by changing the length D1 of the slit S1. In the antenna apparatus of the present embodiment, as described above, when the operating frequency of the antenna element 1 is identical to the resonance frequency of the series resonant circuit 14, the effective length of the slit S1 is the length of the section of the slit S1 from its opening to the series resonant circuit 14, or otherwise, the effective length of the slit S1 is the length of the entire slit S1. In order to change the isolation frequency, the antenna apparatus of the present embodiment does not require circuit elements such as switches, but only needs to change the operating frequency of the antenna element 1. As described above, the antenna apparatus of the present embodiment can operate the single antenna element 1 as two antenna portions, while ensuring isolation between the feed ports at multiple isolation frequencies with a simple configuration, and transmitting and/or receiving multiple radio signals simultaneously.

In the case in which the ground conductor 2 has a similar size to that of the antenna element 1 as illustrated in FIG. 1, the antenna apparatus can be regarded as a dipole antenna made of the antenna element 1 and the ground conductor 2. The ground conductor 2 is excited through one feed port (i.e., the connecting point 2*a*) as a third antenna portion, and simultaneously excited through the other feed port (i.e., the connecting point 2*b*) as a fourth antenna portion, thus also operating the ground conductor 2 as two antenna portions. In this case, since an image (mirror image) of the slit S1 is formed on the ground conductor 2, it is also possible to ensure isolation between the feed ports for the third and fourth antenna portions. With the above-described configuration, it is possible to excite the first and third antenna portions as a first dipole antenna portion through one feed port, and simultaneously, excite the second and fourth antenna portions as a second dipole antenna portion through the other feed port, thus operating a single dipole antenna (i.e., the antenna element 1 and the ground conductor 2) as two dipole antenna portions. Thus, the antenna apparatus of the present embodiment can operate the single dipole antenna as two dipole antenna portions, while ensuring isolation between the feed ports with a simple configuration, and transmit and/or receive multiple radio signals simultaneously.

Now, antenna apparatuses according to modified embodiments of the present invention will be described below with reference to FIGS. 7 to 12.

Figure 7:
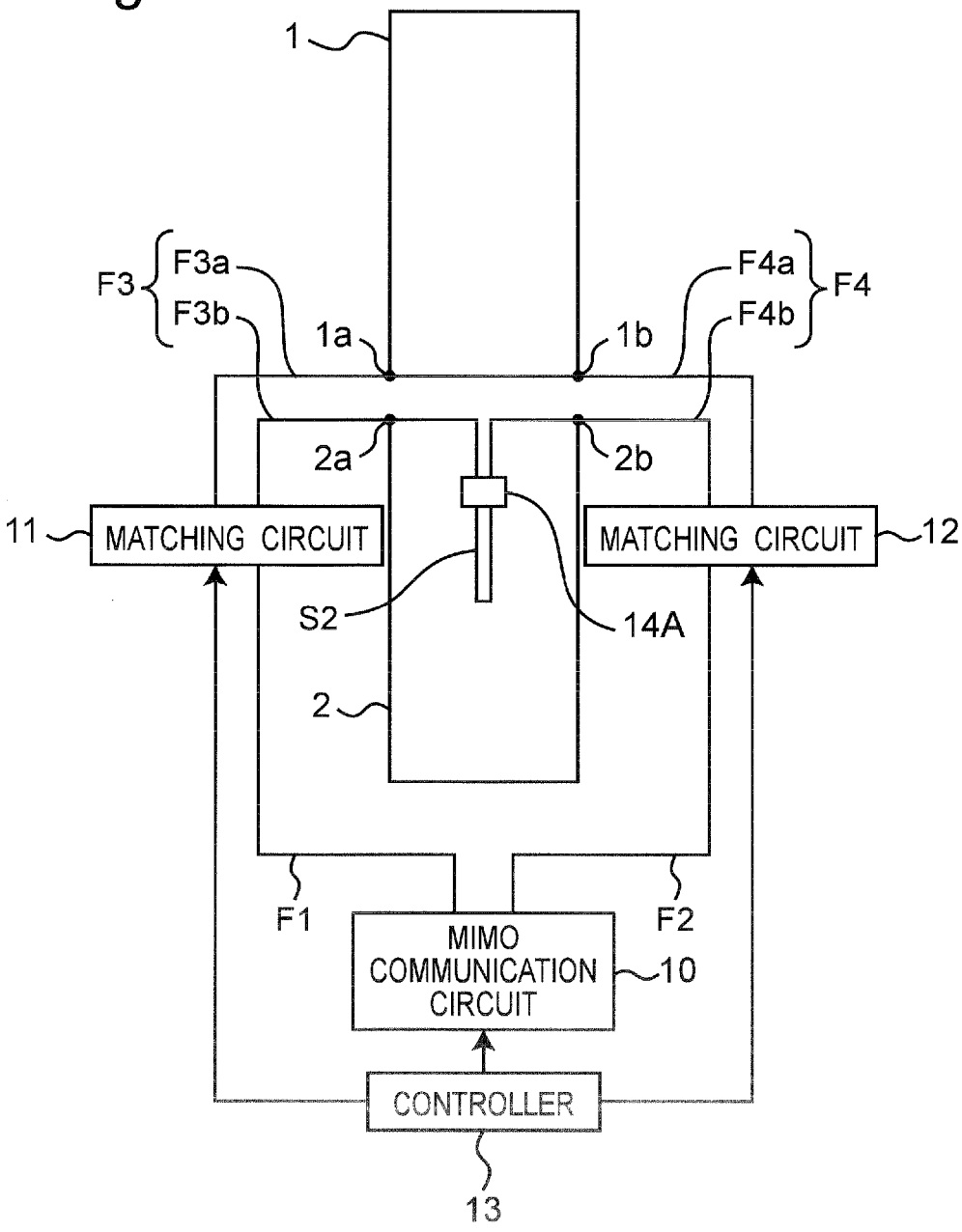
FIG. 7 is a block diagram showing a schematic configuration of an antenna apparatus according to a first modified embodiment of the present invention.

FIG. 7 is a block diagram showing a schematic configuration of an antenna apparatus according to a first modified embodiment of the present invention. In the embodiment of FIG. 1, the antenna element 1 is provided with the slit S1 and the series resonant circuit 14. Alternatively, the ground conductor 2 may be provided with a slit S2 and a series resonant circuit 14A.

Referring to FIG. 7, the ground conductor 2 is provided with the slit S2 between the two feed ports, i.e., between the connecting points 2*a* and 2*b*, in order to adjust electromagnetic coupling and ensuring certain isolation between the feed ports. The slit S2 has a certain width and a certain length, and one end of the slit S2 is configured as an open end, with an opening on the side between the connecting points 2*a* and 2*b*. The antenna apparatus is further provided with the series resonant circuit 14A for changing the effective length of the slit S2, at a location along the slit S2, with a distance from the opening of the slit S2. The series resonant circuit 14A is configured in the same manner as the series resonant circuit 14 of FIG. 1. In this case, in order to achieve at a predetermined frequency both the short-circuiting of the series resonant circuit 14A and the ensuring of isolation, the location of the series resonant circuit 14A is adjusted along the slit S2 so that the isolation frequency is identical to the resonance frequency of the series resonant circuit 14A. In addition, each of feed lines F3 and F4 is configured as a balanced feed line. As illustrated in FIGS. 1 and 7, when the ground conductor 2 has a similar size to that of the antenna element 1, the antenna apparatus operates as a dipole antenna. Thus, also in the present modified embodiment, it is possible to ensure isolation and achieve multi-frequency operation in a manner similar to that of FIG. 1.

As described above, the antenna apparatus of the present modified embodiment can operate the single antenna element 1 as two antenna portions, while ensuring isolation between the feed ports at multiple isolation frequencies with a simple configuration, and transmitting and/or receiving multiple radio signals simultaneously.

Figure 8:
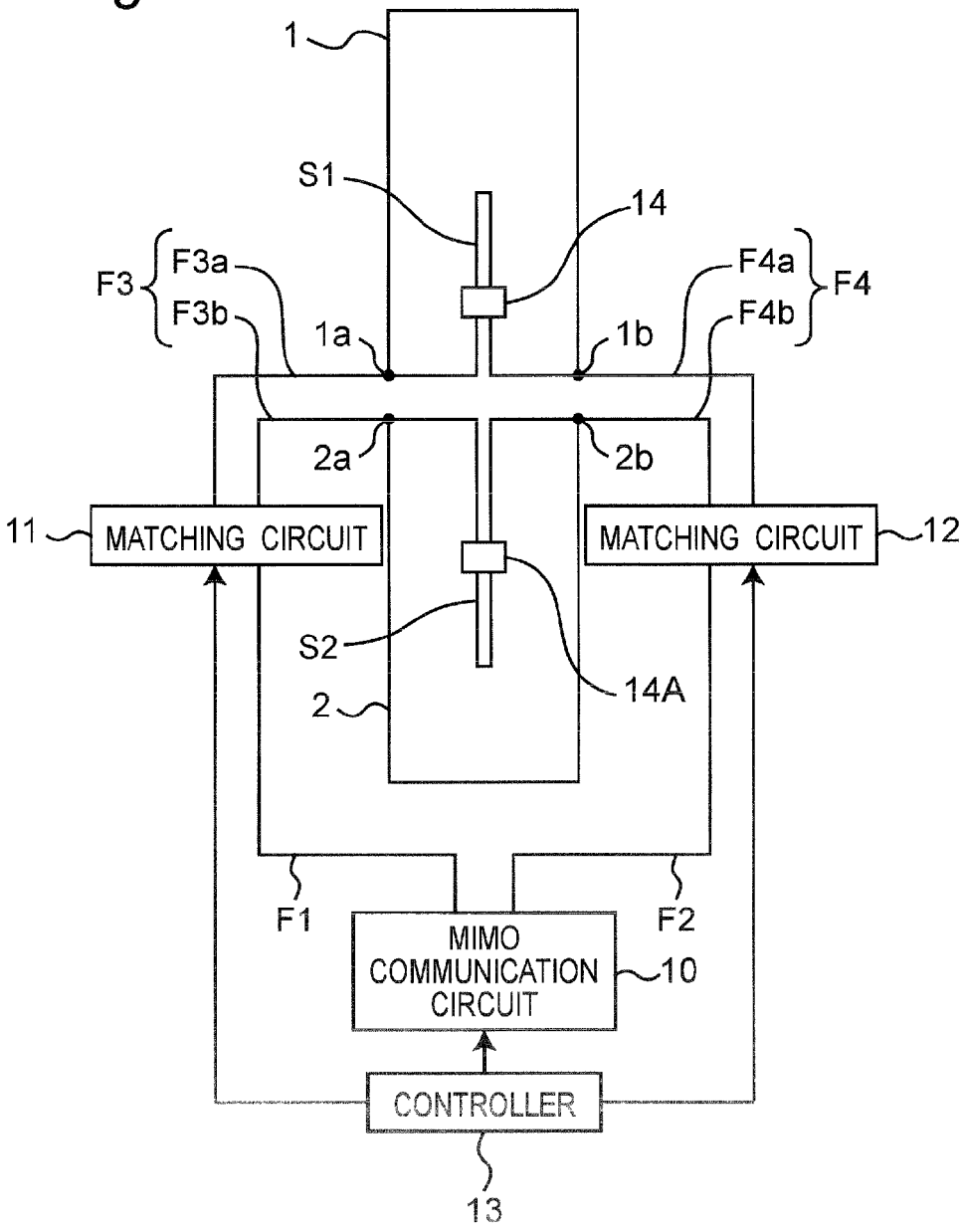
FIG. 8 is a block diagram showing a schematic configuration of an antenna apparatus according to a second modified embodiment of the present invention.

FIG. 8 is a block diagram showing a schematic configuration of an antenna apparatus according to a second modified embodiment of the present invention. The antenna apparatus of the present modified embodiment is characterized by having the configuration of the antenna apparatus of FIG. 1, and further having the slit S2 and the series resonant circuit 14A on the ground conductor 2.

Referring to FIG. 8, the antenna element 1 is provided with the slit S1 and the series resonant circuit 14 as shown in FIG. 1, and the ground conductor 2 is provided with the slit S2 and the series resonant circuit 14A as shown in FIG. 7. The slit S2 is preferably configured to have, for example, a different length from the slit S1, so as to resonate the antenna element 1 and the ground conductor 2 at a frequency, which is different from a frequency at which the antenna element 1 and the ground conductor 2 resonate due to providing the slit S1, and so as to ensure isolation between feed ports at a frequency different from that for the slit S1. Further, the configuration is preferably such that the resonance frequency of the series resonant circuit 14 is different from that of the series resonant circuit 14A, and the length of a section of the slit S1 from its opening to the series resonant circuit 14 is different from the length of a section of the slit S2 from its opening to the series resonant circuit 14A. In this case, as described above, in order to achieve at a predetermined frequency both the short-circuiting of the series resonant circuit 14 and the ensuring of isolation, the location of the series resonant circuit 14 is adjusted along the slit S1 so that the isolation frequency is identical to the resonance frequency of the series resonant circuit 14. Similarly, in order to achieve at another predetermined frequency both the short-circuiting of the series resonant circuit 14A and the ensuring of isolation, the location of the series resonant circuit 14A is adjusted along the slit S2 so that the isolation frequency is identical to the resonance frequency of the series resonant circuit 14A. Thus, such a configuration is provided that when the series resonant circuit 14A resonates and makes its impedance zero, the antenna element 1 and the ground conductor 2 resonate at a frequency, which is different from a frequency at which the antenna element 1 and the ground conductor 2 resonate when the series resonant circuit 14 resonates and makes its impedance zero, and further, isolation between the feed ports is ensured at a frequency, which is different from a frequency at which the series resonant circuit 14 resonates and makes its impedance zero. In the present modified embodiment, preferably, it is possible to achieve four different isolation frequencies as a result of providing the two slits S1 and S2 and the two series resonant circuits 14 and 14A. Each of feed lines F3 and F4 is configured as a balanced feed line. A controller 13 adjusts the operating frequencies of a MIMO communication circuit 10 and matching circuits 11 and 12 to selectively shift the operating frequency of the antenna element 1 and the ground conductor 2 to one of multiple isolation frequencies.

Thus, in the present modified embodiment, it is possible to achieve different resonance frequencies and achieve different isolation frequencies as a result of providing the plurality of slits S1 and S2 and the plurality of series resonant circuits 14 and 14A. In other words, since the slits S1 and S2 are electromagnetically coupled to the antenna element 1 and the ground conductor 2 at different frequencies, respectively, there are a plurality of resonance frequencies of the antenna element 1 and the ground conductor 2, and there are also a plurality of isolation frequencies. It is possible to selectively shift the operating frequency of the antenna element 1 and the ground conductor 2 to one of these isolation frequencies, thus achieving multi-frequency operation of the antenna apparatus.

In the present modified embodiment, instead of using the slits S1 and S2 having different lengths, it is possible to use the slits S1 and S2 having an equal length, thus achieving an identical isolation frequency. Similarly, instead of using the series resonant circuit 14 and the series resonant circuit 14A having different resonance frequencies and using the section of the slit S1 from its opening to the series resonant circuit 14 and the section of the slit S2 from its opening to the series resonant circuit 14A having different lengths, it is possible to have the same frequency and the same length, thus achieving an identical isolation frequency. Thus, it is possible to increase flexibility in the configuration of the antenna apparatus.

As described above, the antenna apparatus of the present modified embodiment can operate the single antenna element 1 as two antenna portions, while ensuring isolation between the feed ports at multiple isolation frequencies with a simple configuration, and transmitting and/or receiving multiple radio signals simultaneously.

Figure 9:
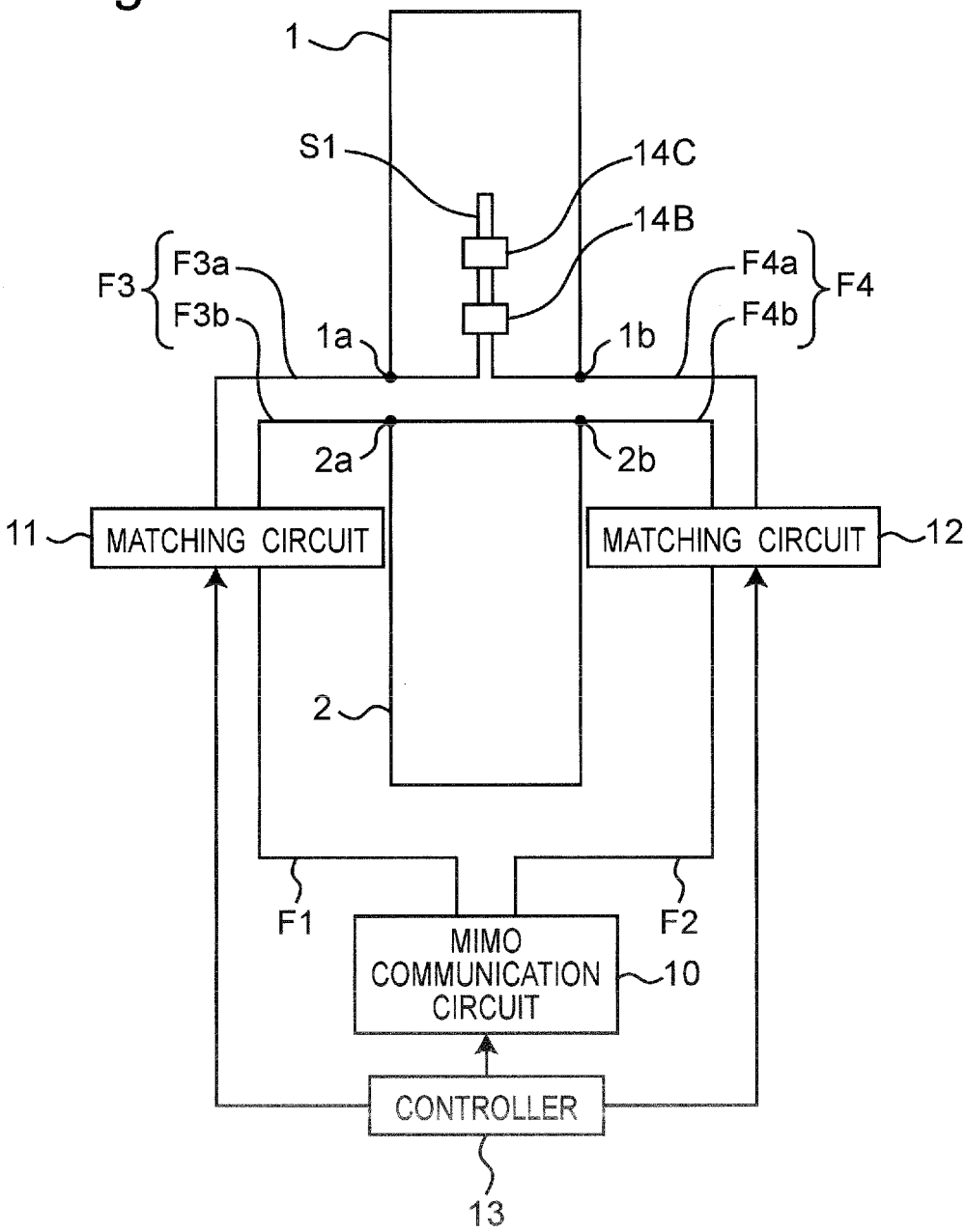
FIG. 9 is a block diagram showing a schematic configuration of an antenna apparatus according to a third modified embodiment of the present invention.

FIG. 9 is a block diagram showing a schematic configuration of an antenna apparatus according to a third modified embodiment of the present invention. The antenna apparatus of the present modified embodiment is characterized by providing the slit S1 with a plurality of series resonant circuits 14B and 14C instead of the single series resonant circuit 14 of FIG. 1, in order to ensure isolation between feed ports at a plurality of isolation frequencies.

Referring to FIG. 9, the antenna apparatus of the present modified embodiment is provided with the series resonant circuit 14B at a location along the slit S1, with a distance from the opening of the slit S1, and further provided with another series resonant circuit 14C at another location along the slit S1, with a farther distance from the opening of the slit S1 than that of the series resonant circuit 14B. The series resonant circuit 14B resonates only at a predetermined resonance frequency and makes its impedance zero (i.e., is substantially short-circuited), and the series resonant circuit 14C resonates only at a predetermined resonance frequency lower than that of the series resonant circuit 14B and makes its impedance zero (i.e., is substantially short-circuited). The series resonant circuits 14B and 14C are substantially open at the other frequencies away from their respective resonance frequencies. Therefore, at the resonance frequency of the series resonant circuit 14B, only a section of the slit S1 from its opening to the series resonant circuit 14B resonates, and at the resonance frequency of the series resonant circuit 14C, only a section of the slit S1 from its opening to the series resonant circuit 14C resonates. At the other frequencies away from these resonance frequencies, the entire slit S1 resonates. Namely, the effective length of the slit S1 changes at three levels, and thus, three isolation frequencies can be attained. Specifically, a controller 13 operates the antenna apparatus at a first isolation frequency identical to the resonance frequency of the series resonant circuit 14B, and at a second isolation frequency identical to the resonance frequency of the series resonant circuit 14C, and at a third isolation frequency lower than the first and second isolation frequencies. When the antenna apparatus operates at the first isolation frequency, the series resonant circuit 14B is substantially short-circuited, and only the section of the slit S1 from its opening to the series resonant circuit 14B resonates, thus providing isolation between first and second feed ports at the first isolation frequency. When the antenna apparatus operates at the second isolation frequency, the series resonant circuit 14B is substantially open and the series resonant circuit 14C is substantially short-circuited, and only the section of the slit S1 from its opening to the series resonant circuit 14C resonates, thus providing isolation between the first and second feed ports at the second isolation frequency. When the antenna apparatus operates at the third isolation frequency, the series resonant circuits 14B and 14C are substantially open, and the entire slit S1 resonates, thus providing isolation between the first and second feed ports at the third isolation frequency.

According to the present modified embodiment, three or more series resonant circuits may be provided in a similar manner. In this case, a plurality of series resonant circuits are respectively provided at locations along the slit S1, with different distances from the opening of the slit S1. The series resonant circuits are substantially short-circuited at different resonance frequencies, respectively, and are substantially open at frequencies away from the resonance frequencies of the series resonant circuits. The controller 13 operates the antenna apparatus at a plurality of isolation frequencies each identical to one of the resonance frequencies of the series resonant circuits. When the antenna apparatus operates at one of the isolation frequencies, one of the series resonant circuits that has a resonance frequency identical to the one isolation frequency is substantially short-circuited, and only a section of the slit S1 from its opening to the one series resonant circuit resonates, thus providing isolation between the first and second feed ports at the one isolation frequency. In the present modified embodiment, by using a plurality of series resonant circuits, it is possible to achieve multi-frequency operation including operations at three or more different frequencies, while ensuring high isolation between the feed ports.

As described above, the antenna apparatus of the present modified embodiment can operate the single antenna element 1 as two antenna portions, while ensuring isolation between the feed ports at multiple isolation frequencies with a simple configuration, and transmitting and/or receiving multiple radio signals simultaneously.

Figure 10:
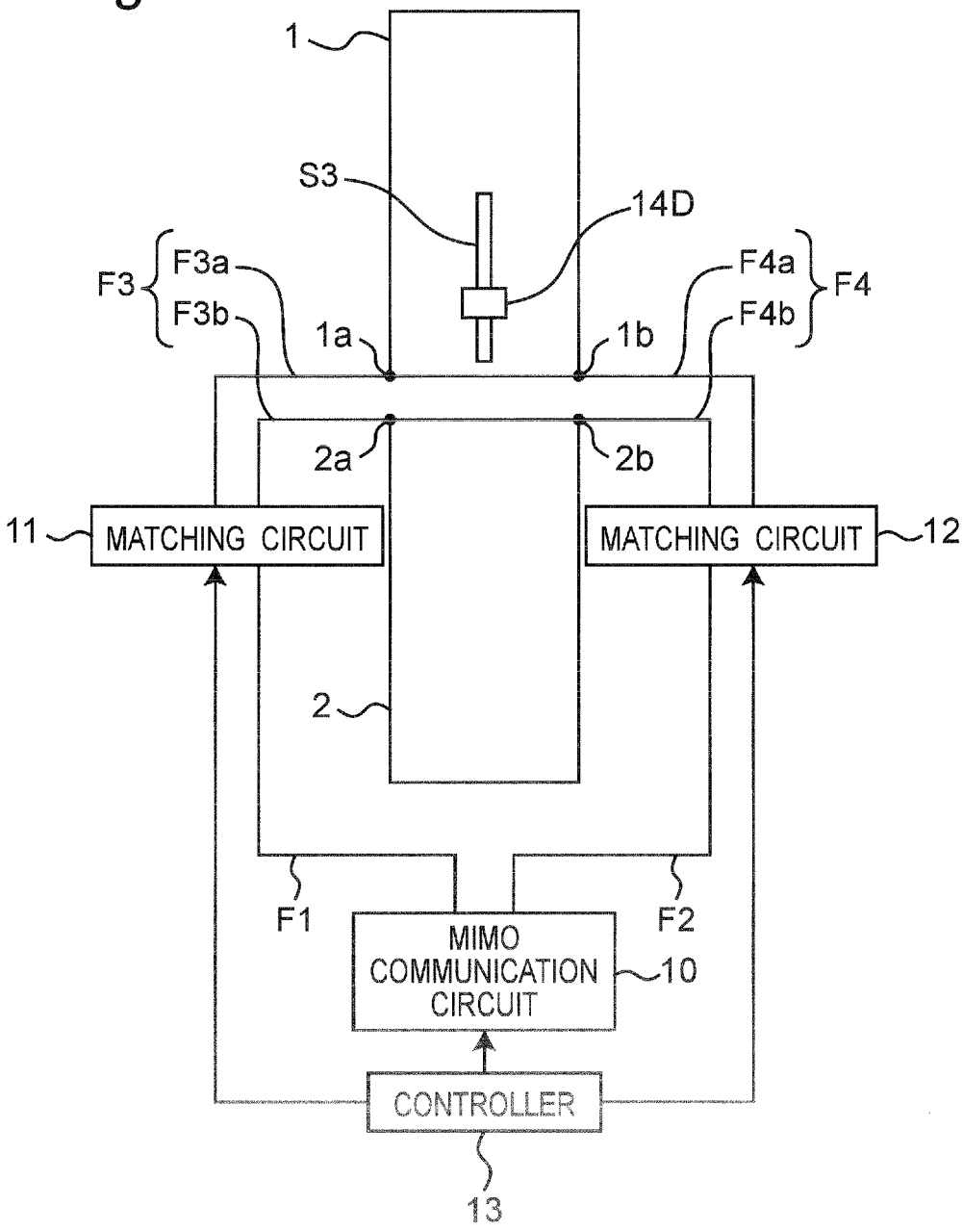
FIG. 10 is a block diagram showing a schematic configuration of an antenna apparatus according to a fourth modified embodiment of the present invention.

FIG. 10 is a block diagram showing a schematic configuration of an antenna apparatus according to a fourth modified embodiment of the present invention. The antenna apparatus of the present modified embodiment is characterized by having a slot S3 with no opening on a side of the antenna element 1, instead of having the slit S1 of FIG. 1.

When the antenna apparatus operates at a first isolation frequency identical to the resonance frequency of a series resonant circuit 14D, the series resonant circuit 14D is substantially short-circuited, and only a section of the slit S3 from its one end to the series resonant circuit 14D resonates, thus providing isolation between first and second feed ports at the first isolation frequency. When the antenna apparatus operates at a second isolation frequency lower than the first isolation frequency, the series resonant circuit 14D is substantially open, and the entire slot S3 resonates, thus providing isolation between the first and second feed ports at the second isolation frequency.

The number of slots is not limited to one, and each of the antenna element 1 and the ground conductor 2 may be provided with one slot. When the antenna element 1 and the ground conductor 2 are of substantially the same size (dipole antenna) and each of feed lines F3 and F4 is a balanced feed line, the configuration may be such that only the ground conductor 2 is provided with a slot without providing the antenna element 1 with the slot S3, in a manner similar to that of the third embodiment. According to the configuration of the present modified embodiment, it is possible to increase flexibility in the configuration of the antenna apparatus.

Even when using such a configuration, the antenna apparatus of the present modified embodiment can operate the single antenna element 1 as two antenna portions, while ensuring isolation between the feed ports at multiple isolation frequencies with a simple configuration, and transmitting and/or receiving multiple radio signals simultaneously.

Figure 11:
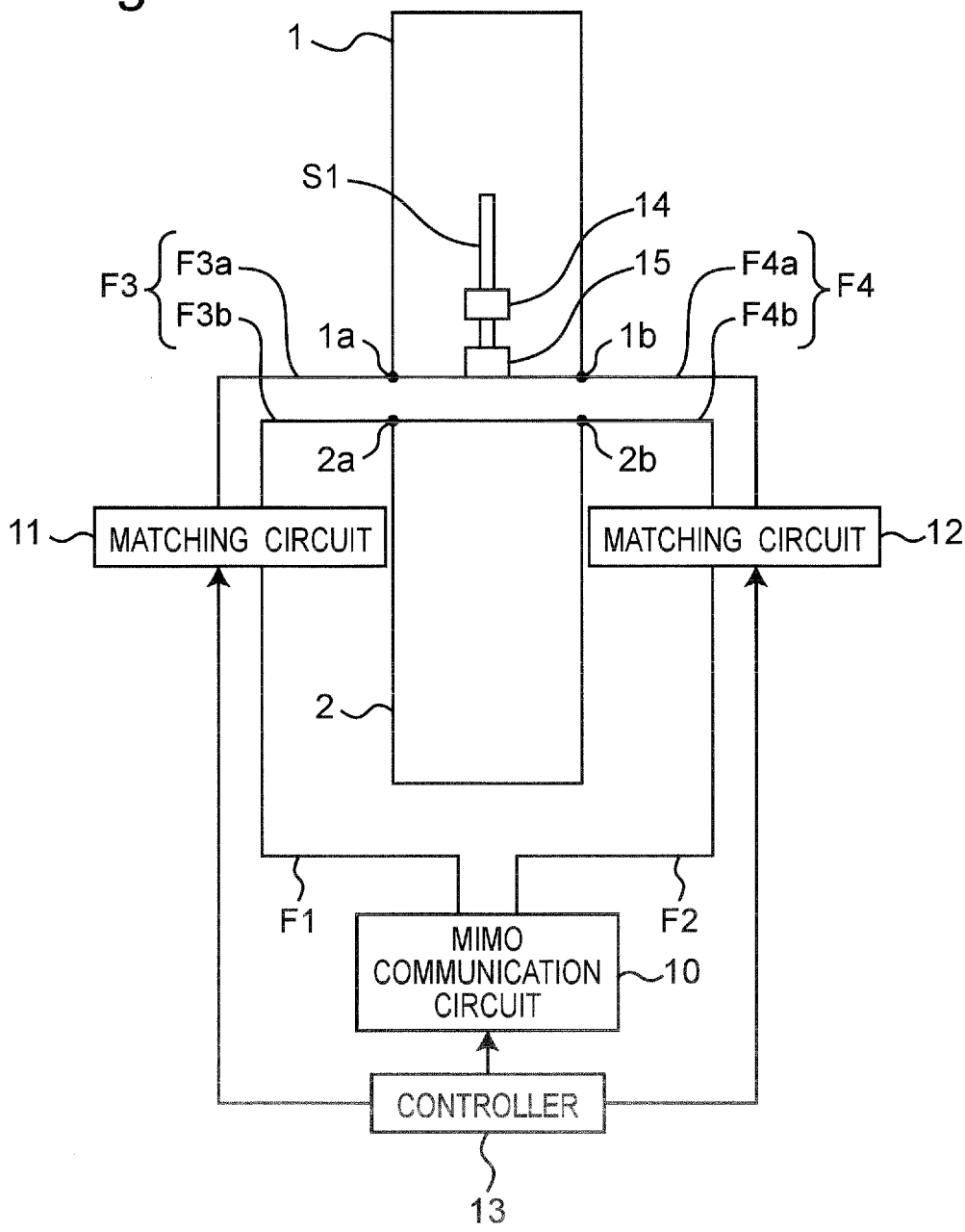
FIG. 11 is a block diagram showing a schematic configuration of an antenna apparatus according to a fifth modified embodiment of the present invention.

FIG. 11 is a block diagram showing a schematic configuration of an antenna apparatus according to a fifth modified embodiment of the present invention. The antenna apparatus of the present modified embodiment is characterized by not only changing the length of the slit S1 in a manner similar to that of FIG. 1, but also providing a reactance element 15 at a location along the slit S1, in order to adjust the resonance frequency of the antenna element 1 and the frequency at which isolation can be ensured.

Referring to FIG. 11, the antenna apparatus of the present modified embodiment has the configuration of FIG. 1, and further has the reactance element 15 at a location along the slit S1, with a distance from an opening of the slit S1. Since the resonance frequency of the antenna element 1 and the frequency at which isolation can be ensured change depending on the length of the slit S1, the length of the slit S1 is determined so as to adjust these frequencies. In order to adjust these frequencies in the present modified embodiment, the reactance element 15 having a reactance value (i.e., a capacitor or an inductor) is further provided at a location along the slit S1. In addition, since these frequencies also change depending on the location at which the reactance element 15 is provided along the slit S1, the location of the reactance element 15 is determined so as to adjust these frequencies. The amount of frequency adjustment (amount of frequency transition) reaches the maximum when the reactance element 15 is provided at the opening of the slit S1. Accordingly, it is possible to finely adjust the resonance frequency of the antenna element 1 and the frequency at which isolation can be ensured, by shifting the mounting location of the reactance element 15 after determining a reactance value of the reactance element 15.

As described above, the antenna apparatus of the present modified embodiment can operate the single antenna element 1 as two antenna portions, while ensuring isolation between the feed ports at multiple isolation frequencies with a simple configuration, and transmitting and/or receiving multiple radio signals simultaneously.

Figure 12:
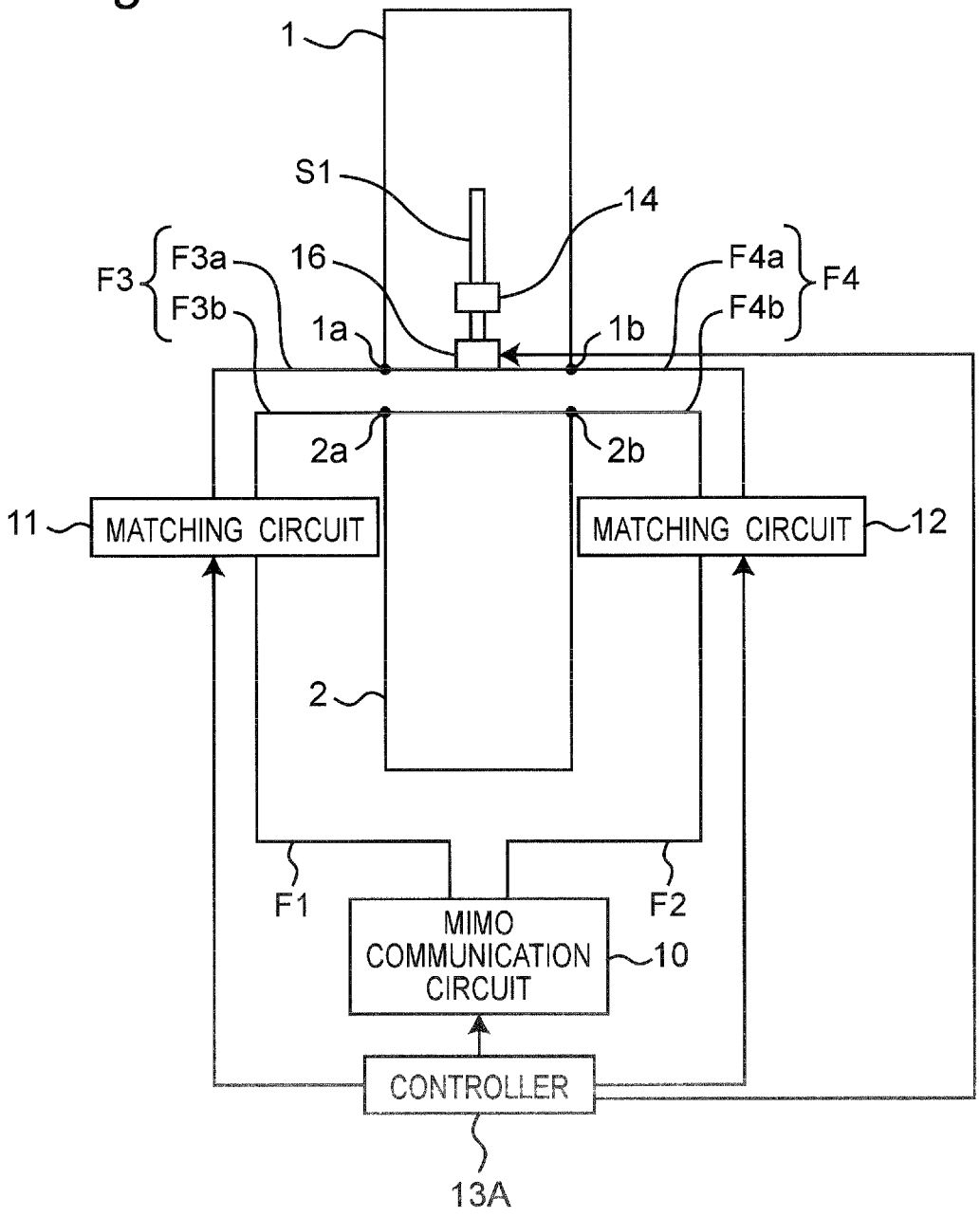
FIG. 12 is a block diagram showing a schematic configuration of an antenna apparatus according to a sixth modified embodiment of the present invention.

FIG. 12 is a block diagram showing a schematic configuration of an antenna apparatus according to a sixth modified embodiment of the present invention. The antenna apparatus of the present modified embodiment is characterized by having a variable reactance element 16 whose reactance value is changed under the control of a controller 13A, instead of having the reactance element 15 of the fifth modified embodiment. Thus, the antenna apparatus of the present modified embodiment can ensure isolation between feed ports at a plurality of isolation frequencies by the single slit S1 having the variable reactance element 16, without a plurality of slits and/or a plurality of series resonant circuits in a manner similar to those of the second and third modified embodiments.

Referring to FIG. 12, the antenna apparatus of the present modified embodiment is provided with the variable reactance element 16 at a location along the slit S1, with a distance from an opening of the slit S1. As the variable reactance element 16, a capacitive reactance element can be used, e.g., including a variable capacitance element such as a varactor diode. The reactance value of the variable reactance element 16 is changed according to a control voltage applied by the controller 13A. The antenna apparatus of the present embodiment is configured so as to change the reactance value of the variable reactance element 16, thus achieving different resonance frequencies of the antenna element 1, and ensuring isolation between the feed ports at different frequencies. The controller 13A changes the reactance value of the variable reactance element 16, and additionally, adjusts the operating frequencies of matching circuits 11 and 12 and a MIMO communication circuit 10, and thus shifts the operating frequency of the antenna element 1 to an isolation frequency which is determined by a reactance value of the variable reactance element 16. In the present embodiment with the above-described configuration, the antenna apparatus can operate at multiple frequencies.

In the present embodiment, it is possible to change the operating frequency of the antenna element 1 according to an application to be used, by adaptively changing the reactance value of the variable reactance element 16.

As described above, the antenna apparatus of the present modified embodiment can operate the single antenna element 1 as two antenna portions, while ensuring isolation between the feed ports at multiple isolation frequencies with a simple configuration, and transmitting and/or receiving multiple radio signals simultaneously.

According to further modified embodiments, the shapes of the antenna element 1 and the ground conductor 2 are not limited to rectangular, and may be other shapes, e.g., polygons, circles, or ellipses. Further, an antenna apparatus can be configured as a combination of the modified embodiments as described above. For example, the reactance element 15 of the fifth modified embodiment or the variable reactance element 16 of the sixth modified embodiment may be provided on at least one slit of one of the antenna apparatuses of the first to third modified embodiments. Similarly, the reactance element 15 of the fifth modified embodiment or the variable reactance element 16 of the sixth modified embodiment may be provided along at least one slot S3 of the antenna apparatus of the fourth modified embodiment. When implementing an antenna apparatus of such combinations, a plurality of resonance frequencies can be adjusted by the slit length or the slot length, the reactance value of the reactance element, and the mounting location of the reactance element, thus increasing flexibility in frequency adjustment. For example, when combining the third modified embodiment with the fifth or sixth modified embodiment, a reactance element or a variable reactance element can be provided at at least one of the following locations: the opening of the slit S1; a location between the series resonant circuits 14B and 14C; and a location farther than the series resonant circuit 14C. When combining the fourth modified embodiment with the fifth or sixth modified embodiment, a reactance element or a variable reactance element can be provided at, for example, substantially the middle of the slot S3 along its longitudinal direction. In addition, it is possible to combine the third and fourth modified embodiment, i.e., provide the slot with a plurality of series resonant circuits. Furthermore, instead of MIMO communication circuits 10, a wireless communication circuit for modulating and demodulating two independent radio signals may be provided. In this case, an antenna apparatus of the present embodiment can simultaneously perform wireless communications for multiple applications, and can simultaneously perform wireless communications in multiple frequency bands.

The antenna apparatuses and the wireless apparatuses including the antenna apparatuses according to the present invention can be implemented as, e.g., mobile phones, or wireless LAN apparatuses. The antenna apparatuses can be mounted on wireless communication apparatuses for performing, e.g., MIMO communication. In addition to MIMO, the antenna apparatuses can also be mounted on wireless communication apparatuses capable of simultaneously performing communications for multiple applications.

REFERENCE SIGNS LIST

1: ANTENNA ELEMENT,
1*a* and 1*b*: FEED POINT,
2*a* and 2*b*: CONNECTING POINT,
2: GROUND CONDUCTOR,
10: MIMO COMMUNICATION CIRCUIT,
11 and 12: IMPEDANCE MATCHING CIRCUIT,
13 and 13A: CONTROLLER,
14, 14A, 14B, 14C, and 14D: SERIES RESONANT CIRCUIT,
15: REACTANCE ELEMENT,
156 VARIABLE REACTANCE ELEMENT,
S1 and S2: SLIT,
S3: SLOT,
F1, F2, F3, and F4: FEED LINE,
F3*a*, F3*b*, F4*a*, and F4*b*: SIGNAL LINE,
C: CAPACITOR,
L: INDUCTOR, and
P1 and P2: SIGNAL SOURCE.

The invention claimed is:

1. An antenna apparatus comprising first and second feed ports respectively provided at positions on single planar antenna element, the single planar antenna element being simultaneously excited through the first and second feed ports so as to simultaneously operate as first and second portions respectively associated with the first and second feed ports, wherein the antenna apparatus further comprises:

a slit provided on the single planar antenna element between the first and second feed ports;

a resonant circuit, which is provided at a location along the slit, with a distance from an opening of the slit, and which is substantially short-circuited at a predetermined resonance frequency and is substantially open at frequencies away from the resonance frequency; and a controller for operating the antenna apparatus at a first isolation frequency identical to the resonance frequency of the resonant circuit, and at a second isolation frequency lower than the first isolation frequency, wherein when the antenna apparatus operates at the first isolation frequency, the resonant circuit is substantially short-circuited, and only a section of the slit from the opening to the resonant circuit resonates, thereby providing isolation between the first and second feed ports at the first isolation frequency, and when the antenna apparatus operates at the second isolation frequency, the resonant circuit is substantially open, and the entire slit resonates, thereby providing isolation between the first and second feed ports at the second isolation frequency.

2. The antenna apparatus as claimed in claim 1, wherein the resonant circuit includes a capacitor and an inductor connected in series.

3. The antenna apparatus as claimed in claim 1, comprising a plurality of resonant circuits provided at locations along the slit, with different distances from the opening of the slit, respectively, the plurality of resonant circuits being substantially short-circuited at different predetermined resonance frequencies and being substantially open at frequencies away from their respective resonance frequencies, wherein the controller operates the antenna apparatus at a plurality of first isolation frequencies each identical to one of the resonance frequencies of the resonant circuits, and wherein when the antenna apparatus operates at one of the first isolation frequencies, one of the resonant circuits that has a resonance frequency identical to the one first isolation frequency is substantially short-circuited, and only a section of the slit from the opening to the one resonant circuit resonates, thereby providing isolation between the first and second feed ports at the one first isolation frequency.

4. The antenna apparatus as claimed in claim 1, further comprising a reactance element provided along the slit.

5. The antenna apparatus as claimed in claim 1, further comprising a variable reactance element provided along the slit, wherein the controller changes a reactance value of the variable reactance element.

6. The antenna apparatus as claimed in claim 1, further comprising impedance matching circuits each connected to one of the first and second feed ports, the impedance matching circuits shifting an operating frequency of the single planar antenna element to the first or second isolation frequency under control of the controller.

7. The antenna apparatus as claimed in claim 1, wherein the antenna apparatus is configured as a dipole antenna including a first antenna element and a second antenna element, wherein the first feed port is provided at a first position where the first antenna elements opposes to the second antenna elements, wherein the second feed port is provided at a second position which is different from the first position and where the first antenna elements opposes to the second antenna elements, and wherein at least one slit and at least one resonant circuit are provided on at least one of the first and second antenna elements.

8. An antenna apparatus comprising first and second feed ports respectively provided at positions on single planar antenna element, the single planar antenna element being simultaneously excited through the first and second feed ports so as to simultaneously operate as first and second antenna portions respectively associated with the first and second feed ports, wherein the antenna apparatus further comprises:

a slot provided on the single planar antenna element between the first and second feed ports;

a resonant circuit, which is provided at a location along the slot, and which is substantially short-circuited at a predetermined resonance frequency and is substantially open at frequencies away from the resonance frequency; and a controller for operating the antenna apparatus at a first isolation frequency identical to the resonance frequency of the resonant circuit, and at a second isolation frequency lower than the first isolation frequency, wherein when the antenna apparatus operates at the first isolation frequency, the resonant circuit is substantially short-circuited, and only a section of the slot from one end of the slot to the resonant circuit resonates, thereby providing isolation between the first and second feed ports at the first isolation frequency, and when the antenna apparatus operates at the second isolation frequency, the resonant circuit is substantially open, and the entire slot resonates, thereby providing isolation between the first and second feed ports at the second isolation frequency.

9. A wireless communication apparatus transmitting and receiving multiple radio signals, the wireless communication apparatus comprising an antenna apparatus, the antenna apparatus comprising first and second feed ports respectively provided at positions on single planar antenna element, the single planar antenna element being simultaneously excited through the first and second feed ports so as to simultaneously operate as first and second antenna portions respectively associated with the first and second feed ports, wherein the antenna apparatus further comprises:

a slit provided on the single planar antenna element between the first and second feed ports;

a resonant circuit, which is provided at a location along the slit, with a distance from an opening of the slit, and which is substantially short-circuited at a predetermined resonance frequency and is substantially open at frequencies away from the resonance frequency; and a controller for operating the antenna apparatus at a first isolation frequency identical to the resonance frequency of the resonant circuit, and at a second isolation frequency lower than the first isolation frequency, wherein when the antenna apparatus operates at the first isolation frequency, the resonant circuit is substantially short-circuited, and only a section of the slit from the opening to the resonant circuit resonates, thereby providing isolation between the first and second feed ports at the first isolation frequency, and when the antenna apparatus operates at the second isolation frequency, the resonant circuit is substantially open, and the entire slit resonates, thereby providing isolation between the first and second feed ports at the second isolation frequency.

* * * * *